US011534369B2

(12) United States Patent
Azam

(10) Patent No.: US 11,534,369 B2
(45) Date of Patent: Dec. 27, 2022

(54) HEART ATTACK PILL HOLDER CONFIGURED FOR STORAGE IN WALLETS

(76) Inventor: Shabbir Azam, Canyon Country, CA (US)

( * ) Notice: Subject to any disclaimer, the term of this patent is extended or adjusted under 35 U.S.C. 154(b) by 0 days.

(21) Appl. No.: 12/564,759

(22) Filed: Sep. 22, 2009

(65) Prior Publication Data

US 2022/0362103 A1 Nov. 17, 2022

(51) Int. Cl.
*A61J 1/03* (2006.01)
*B65D 25/10* (2006.01)

(52) U.S. Cl.
CPC ..... *A61J 1/03* (2013.01); *B65D 25/10* (2013.01)

(58) Field of Classification Search
CPC ..... B65D 25/10; B65D 25/108; A61J 1/03; A61J 1/035
USPC ..... 206/528, 534, 38, 38.1, 540, 37, 828, 206/486, 472; 224/600, 201
See application file for complete search history.

(56) References Cited

U.S. PATENT DOCUMENTS

| | | | | |
|---|---|---|---|---|
| 2,644,259 | A * | 7/1953 | Beadle | 40/312 |
| 4,093,103 | A * | 6/1978 | Mumford | 220/283 |
| 4,991,759 | A * | 2/1991 | Scharf | 224/217 |
| 5,292,024 | A * | 3/1994 | Koefelda et al. | 220/608 |
| 5,320,219 | A * | 6/1994 | Ward | 206/224 |
| 5,423,419 | A * | 6/1995 | Wentz et al. | 206/6 |
| 5,456,379 | A * | 10/1995 | Krupa et al. | 220/835 |
| 6,155,409 | A * | 12/2000 | Hettinger | 206/38 |
| 6,382,410 | B1 * | 5/2002 | Magid et al. | 206/38.1 |
| 6,758,338 | B2 * | 7/2004 | Lien | 206/534 |
| 2001/0035442 | A1 * | 11/2001 | Yokobori | 224/197 |
| 2004/0045863 | A1 * | 3/2004 | Rhoades | 206/534 |
| 2006/0169621 | A1 * | 8/2006 | Rulifson | 206/534 |

* cited by examiner

*Primary Examiner* — Steven A. Reynolds

(57) ABSTRACT

A pill holder includes a relatively flat receptacle. The flat receptacle includes a body having a bottom wall having a plurality of depressions, a cover having a top wall overlying the bottom wall, and a hinge disposed to pivotally connect the body to the cover, wherein the cover may be disposed in a closed condition in which the cover overlies and abuts the body, and an open condition wherein the cover is pivoted away from the body. The receptacle includes a first seal forming a short wall fixed to the bottom wall and projecting towards the cover when the cover overlies the bottom wall, and a post fixed to the bottom wall and projecting towards the cover when the cover overlies the bottom wall. The post is located within the fence formed by the first seal.

9 Claims, 2 Drawing Sheets

HEART ATTACK PILL HOLDER CONFIGURED FOR STORAGE IN WALLETS

FIELD OF THE INVENTION

The present invention relates to a pill holder for holding pills appropriate for treating heart attacks, and more particularly, to a pill holder which is dimensioned and configured to be readily portable within a wallet.

BACKGROUND OF THE INVENTION

Heart attacks may strike unexpectedly at any time. If treated timely, prospects for recovery from a heart attack are favorable. However, timely treatment may demand almost immediate treatment.

Aspirin and nitroglycerine tablets have been provided for combating heart attacks. However, both are typically stored in bottles or similar receptacles, which bottles and receptacles, although portable, are sufficiently large so as to discourage keeping them close at hand throughout the day.

There exists a need for a highly compact holder which contains both aspirin and nitroglycerine tablets for combating heart attacks.

SUMMARY OF THE INVENTION

The present invention provides a highly compact carrier, or pill holder, for pills for combating heart attacks. The carrier comprises a flat, hinged receptacle. The receptacle is dimensioned and configured to fit within slots formed in wallets for holding credit cards. The receptacle may hold aspirin and nitroglycerine tablets in recesses, and information such a medical history of the user and emergency instructions such as CPR instructions.

The compact size of the pill holder assures that the pill holder is practical to carry about in a wallet.

It is an object of the invention to provide a pill holder for pills appropriate for combating heart attacks.

Another object of the invention is to make a pill holder for pills for combating heart attacks sufficiently compact as to be carried in a wallet.

A further object is to make aspirin and nitroglycerine expeditiously available while held on the person.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
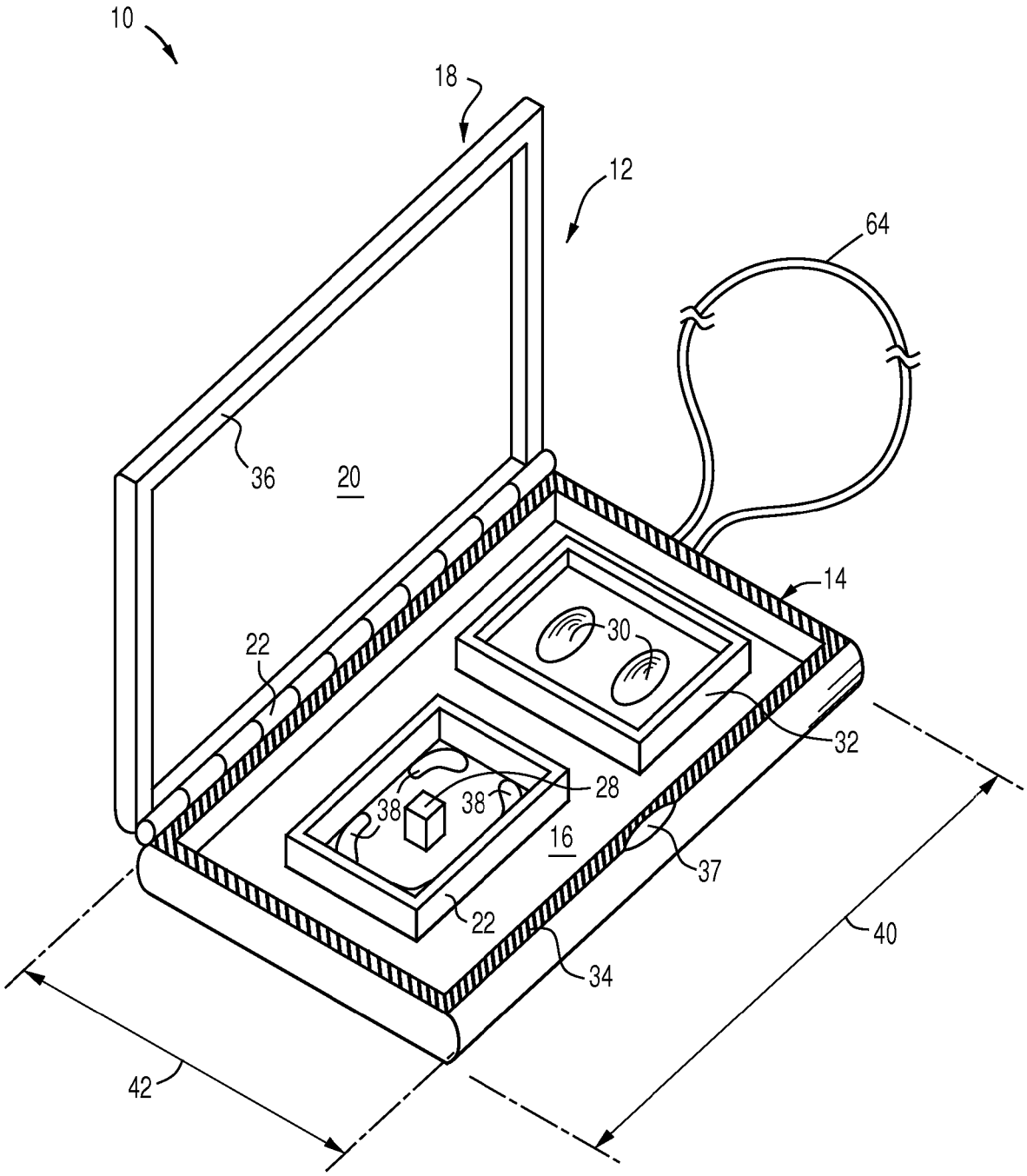
FIG. 1 is a perspective view of a pill holder according to at least one aspect of the invention, showing a closure of the receptacle in an open condition.
Figure 2:
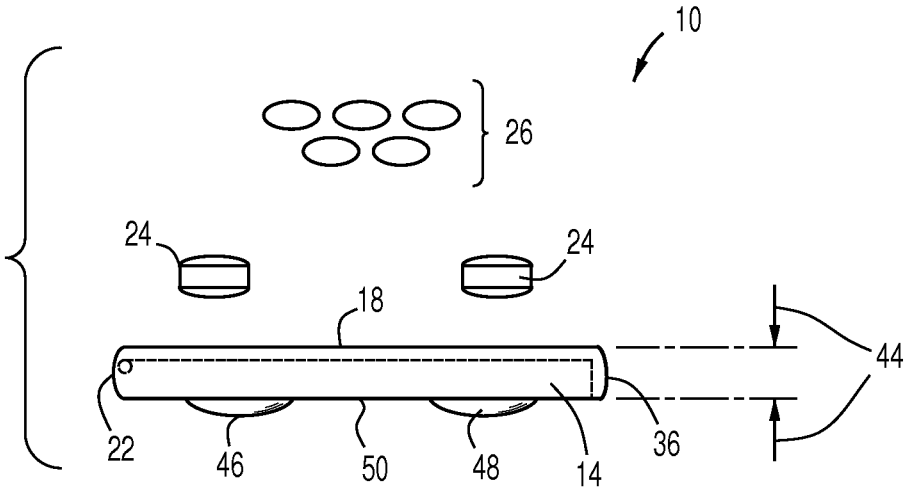
FIG. 2 is an exploded side view of the receptacle of FIG. 1, with the closure of the receptacle shown in a closed condition, and also showing representative medicaments which may be contained within the pill holder.

Referring first to FIG. 1, a pill holder 10 for combating heart attacks may according to at least one aspect of the invention comprise a relatively a relatively flat receptacle 12 having a body 14 having a bottom wall 16, a cover 18 having a top wall 20 disposed to overlie the bottom wall 16 when the cover 18 is in a closed condition (see FIG. 2), and a hinge 22 disposed to pivotally connect the body 14 to the cover 18. As seen in FIG. 2, the cover 18 may be disposed in a closed condition in which the cover 18 overlies and abuts the body 14. By contrast, FIG. 1 shows an open condition wherein the cover 18 is pivoted away from the body 14, thereby revealing contents of the receptacle 12.

Contents of the receptacle 12 are stored in open compartments formed in the bottom wall 16. The bottom wall 16 may comprise a first seal such as a gasket forming a short wall 22 fixed to the bottom wall 16, which projects towards the cover 18 when the cover 18 overlies the bottom wall 16. The seal forming the short wall 22 forms a fence for encircling medicaments such as nitroglycerine tablets 26 (see FIG. 2) which may be stored within the short wall 22. The pill holder 10 may also include aspirin tablets 24 which may be stored within the receptacle 12. A post 28 may be fixed to the bottom wall 16 and may project towards the cover 18 when the cover 18 overlies the bottom wall 16. The post 28 may be located within the fence or short wall 22 formed by the first seal, for opposing compressive forces which may be imposed on contents stored therein. A plurality of depressions 30 may be formed in the bottom wall 16, for receiving the tablets 24 which may be stored in the plurality of depressions 30.

A second seal 32 such as a gasket may be disposed on the bottom wall 16 and project therefrom in the direction of the cover 18 when the cover 18 is in the closed condition. The second seal 32 may seal the depressions 30 when the cover 18 is in the closed condition seen in FIG. 2. Thus the aspirin tablets 24 may be sealed against permeation by air and liquids independently from the nitroglycerine tablets 26.

The receptacle 12 may be redundantly sealed against permeation by air and liquids by a peripheral seal located along the periphery of the body 14 of the receptacle 12. The peripheral seal may comprise a gasket 34 disposed along the periphery of the bottom wall 16 and of the cover 18 when the cover 18 is in the closed condition, and may be disposed to seal all of the contents of the receptacle 12 when the cover 18 is in the closed condition of FIG. 2.

It should be emphasized that as employed herein, the term "seal" is used in a functional sense encompassing any and all structure required to effect a sealing condition. A seal may therefore comprise a single gasket, such as the gasket 34, which comes to abut a surface of a component which is not a gasket, or alternatively may comprise more than one gasket, which gaskets come to abut one another.

The cover 18 may comprise a depending lip 36 which extends outside the periphery of the body 14 and overlaps the body 14 to close the cover 18 to the body 14 when the cover 18 is in the closed condition. Envelopment of the body 14 by the depending lip 36 is best seen in FIG. 2. The depending lip 36 may be engaged by fingernail for example, using a recess 37 formed in the body 14 of the receptacle.

A plurality of ribs 38 may be formed on the bottom wall 16 proximate the first seal or short wall 22 to project towards the cover 18 when the cover 18 is in the closed position. These ribs 38 may stiffen the bottom wall 16, and may also assist in maintaining the short wall 22 in place, especially where the short wall 22 comprises a rubbery or flexible gasket which is not fixed to the bottom wall 16 by adhesive for example. The short wall 22 may resiliently grip the ribs 38 by contracting thereabout.

The receptacle 12 may have length 40 and width 42 each extending in different orthogonal directions. The length 40 may be about eighty millimeters. The width 42 may be about fifty millimeters.

Looking particularly at FIG. 2, the receptacle 12 may have overall thickness 44, including that of the cover 18 which is limited to about five millimeters throughout most of the footprint or area of the receptacle 12. The footprint or area of the receptacle 12 is that surface which would be seen when viewing the receptacle 12 in top plan view or in bottom plan view, with the thickness not being visible. The thickness is that dimension which extends from the bottom wall 16 to the cover 18 when the cover 18 is in the closed condition, and extends in an orthogonal direction different from those of both the length 40 and the width 42.

Each one of the depressions 30 formed in the bottom wall 16 may have dimensions and configuration such that it has a corresponding bulge 46 or 48 formed in the bottom wall 16. Each bulge 46 or 48 projects away from the cover 18 when the cover 18 is in the closed condition. These bulges 46, 48 account for a minority of the area of the lower surface 50 of the bottom wall 16, so that it may be said that the overall thickness 44 of the receptacle 12 is limited to the five millimeter magnitude throughout most of the footprint or area of the bottom wall 16.

Figure 3:
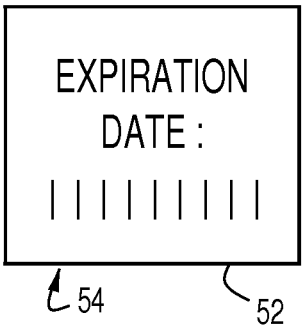
FIG. 3 is a plan view of a substrate which may form part of the pill holder, bearing information related to expiration dates of medicaments which may be contained within the pill holder.

The pill holder 10 may comprise one or more substrates bearing medical information related to at least one of a person using the pill holder and to heart attacks generally. FIG. 3 shows a substrate 52 which may bear indicia 54 relating to an expiration date applying to the nitroglycerine tablets or to the aspirin tablets or to both. The substrate 52 may be for example a label bearing adhesive (not shown), and may be adhered to the bottom wall 16 proximate that medicament (i.e., the aspirin tablets 24 or the nitroglycerine tablets 26) the expiration date of which is annunciated by the indicia 54.

Figure 4:
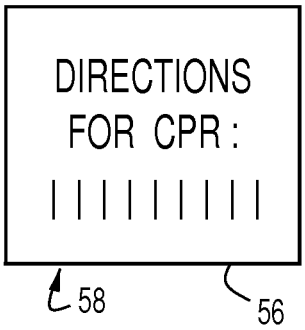
FIG. 4 is a plan view of a substrate which may form part of the pill holder, bearing information related to directions for performing CPR.

FIG. 4 shows a substrate 56 which may bear indicia 58 relating to directions for performing a cardiopulmonary resuscitation procedure.

Figure 5:
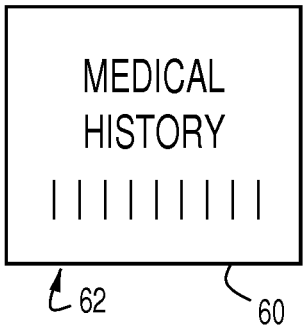
FIG. 5 is a plan view of a substrate which may form part of the pill holder, bearing information related to the medical history of a person such as a user of the pill holder.

FIG. 5 shows a substrate 60 which may bear indicia 62 comprising medical history data for a person, such as the user of the pill holder 10.

The substrates 52, 56, 60 may be adhered or otherwise permanently fixed to the receptacle 12 in any appropriate or desired location, or may be loose and separable from the receptacle 12. For example, it may be desirable to enable a person to remove directions for performing a CPR procedure from the receptacle for close inspection while reading. It would be possible for at least one of the substrates 52, 56, 60 to be permanently fixed, and at least one other of the substrates 52, 56, 60 to be separable from the receptacle 12.

Again referring to FIG. 1, the pill holder 10 may comprise a flexible tether 64 fixed to the receptacle 12, of dimensions and configuration enabling the tether 64 to be worn around the neck of a user (not shown) of the pill holder 10.

With or without the flexible tether 64, the pill holder 10 may be stored in a wallet (not shown) due to its configuration and dimensions, and even more particularly within slots of a wallet which are intended to store credit cards and the like (none shown). The user of the pill holder 10 therefore has ready access to the pill holder 10, regardless of whether the pill holder 10 is kept in a wallet or around the neck of the user.

As employed herein, the term "tablet" will be understood to signify tablets, capsules, pills, and all forms of medicaments provided as discrete doses in predetermined or standard quantities, wherein each discrete dose may be handled by the user as a single object. The discrete doses may be enclosed within a coating of a substance which itself is different from the medicament contained therein, or may comprise the medicament itself, such as a compressed powdered medicament.

Although the invention has been described in terms of certain components being referred to in specified numbers and arrangements, other arrangements are possible. For example, it is to be understood that due to the conceptual description presented herein, components presented in the singular may be provided in the plural. Illustratively, more than one compartment for each type of medicament may be provided.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A pill holder for combating heart attacks, comprising:

a relatively flat receptacle having a rectangular-shaped body having a bottom wall having a plurality of depressions, a cover having a top wall overlying the bottom wall, and a hinge disposed to pivotally connect the rectangular-shaped body to the cover, a rotation axis of the hinge is parallel to a length of the rectangular-shaped body, wherein the cover may be disposed in a closed condition in which the cover overlies and abuts the rectangular-shaped body, and an open condition wherein the cover is pivoted away from the rectangular-shaped body, thereby revealing contents of the receptacle, the bottom wall comprises a first seal forming a short wall fixed to the bottom wall and projecting towards the cover when the cover overlies the bottom wall, the short wall having an inside face and an outside face, wherein the first seal forming the short wall forms a fence for encircling tablets which may be stored in the relatively flat receptacle within the short wall, a post fixed to the bottom wall and projecting towards the cover when the cover overlies the bottom wall, wherein the post is located within the fence formed by the first seal, for opposing compressive forces which may be imposed on contents stored within the fence, and a second seal disposed on the bottom wall and projecting therefrom in the direction of the cover when the cover is in the closed condition, and disposed to seal the plurality of depressions when the cover is in the closed condition, at least one rib disposed on the bottom wall within the fence formed by the first seal to project towards the cover when the cover is in the closed position, a substrate bearing medical information related to at least one of a person using the pill holder and heart attacks generally, a tether fixed to the receptacle, of dimensions and configuration enabling the tether to be worn around the neck of a user of the pill holder.

2. The pill holder according to claim 1, further comprising a peripheral seal located along the periphery of the rectangular-shaped body of the receptacle, wherein the peripheral seal comprises a gasket disposed along the periphery of the bottom wall and of the cover when the cover is in the closed condition, and disposed to seal all of the contents of the receptacle when the cover is in the closed condition.

3. The pill holder according to claim 1, wherein the cover comprises a depending lip which extends outside the periphery of the rectangular-shaped body and overlaps the rectangular-shaped body to close the cover to the rectangular-shaped body when the cover is in the closed condition.

4. The pill holder according to claim 1, wherein the receptacle has thickness in the direction extending from the bottom wall to the cover when the cover is in the closed condition, and wherein the thickness of the receptacle throughout most of the area of the receptacle, as determined by the length and the width of the receptacle, is limited to about five millimeters.

5. The pill holder according to claim 4, wherein the receptacle has length and width each in an orthogonal direction perpendicular to the thickness, and the length is about eighty millimeters and the width is about fifty millimeters.

6. The pill holder according to claim 1, wherein each one of the depressions formed in the bottom wall has a corresponding bulge formed in the bottom wall and projecting away from the cover when the cover is in the closed condition.

7. The pill holder according to claim 1, wherein the medical information comprises an expiration date applying to at least one of nitroglycerine tablets and aspirin tablets.

8. The pill holder according to claim 1, wherein the medical information comprises directions for performing a cardiopulmonary resuscitation procedure.

9. The pill holder according to claim 1, wherein the medical information comprises medical history data for a person.

* * * * *